US005419032A

United States Patent [19]

Rytych

[11] Patent Number: 5,419,032

[45] Date of Patent: May 30, 1995

[54] METHOD FOR FORMING A CONTAINER RING

[75] Inventor: Andrew Rytych, Chicago, Ill.

[73] Assignee: A.R. Tech & Tool, Inc., Chicago, Ill.

[21] Appl. No.: 167,635

[22] Filed: Dec. 14, 1993

[51] Int. Cl.[6] ..... B21D 39/00

[52] U.S. Cl. ..... 29/511; 29/509; 29/516; 72/106

[58] Field of Search ..... 72/86, 87, 106, 379.2, 72/379.4, 379.6; 29/509, 510, 515, 516, 243, 517, 511; 220/642

[56] References Cited

U.S. PATENT DOCUMENTS

| | | | |
|---|---|---|---|
| 1,258,538 | 3/1918 | Darley, Jr. . | |
| 1,409,336 | 3/1922 | Fahlman . | |
| 1,466,643 | 8/1923 | Draper | 220/642 |
| 1,548,177 | 8/1925 | Strange | 29/516 |
| 1,671,735 | 5/1928 | McCrery . | |
| 1,672,581 | 6/1928 | Sutcliffe et al. | 220/642 |
| 1,716,725 | 6/1929 | Gruber . | |
| 1,952,401 | 3/1934 | Wilson . | |
| 2,227,746 | 1/1941 | Clark | 72/106 |
| 2,574,509 | 11/1951 | Stuart | 29/509 |
| 2,714,469 | 8/1955 | Carlson . | |
| 4,454,739 | 6/1984 | Ciccorelli | 72/106 |
| 4,708,283 | 12/1987 | Brazil . | |

*Primary Examiner*—Mark Rosenbaum
*Assistant Examiner*—David P. Bryant
*Attorney, Agent, or Firm*—Willian Brinks Hofer Gilson & Lione

[57] ABSTRACT

An apparatus for forming a container closure includes at least one driving wheel, at least one biasing wheel, a first bending wheel and a second bending wheel. The biasing wheel operates to hold a metal band having a first edge and a second edge against the driving wheel. While the band is rotated by the driving wheel, the first bending wheel bends the first edge of the band and, subsequently, the second bending wheel bends the second edge of the band. The apparatus operates to form the container closure without an operator having to stop the apparatus after the first edge is bent to turn the band over so that the second edge can be bent.

14 Claims, 3 Drawing Sheets

METHOD FOR FORMING A CONTAINER RING

BACKGROUND OF THE INVENTION

The present invention relates to an apparatus and method for forming rings for bulk containers and the like.

Container rings for bulk containers and the like are well known and varied. Typically, most container rings are formed from a metallic strip whose ends are welded or otherwise connected together to form a band. Usually, hooks are formed along the upper and lower edges of the ring band. The upper hooked edge is placed over the opening edge of a bulk container, and the hooked edge and the opening edge of the container are crimped together to secure the band to the container. The remaining portion of the band, including the lower hooked edge, rests against the outside wall of the bulk container. The lower hooked edge of the band, which is bent in towards the container, creates a "safety hook." When, for example, the bulk container is lifted and moved, the "safety hook" prevents persons from cutting or injuring themselves.

While the above-described container ring has produced satisfactory results in the bulk container field, there are a number of disadvantages relating to the container ring. First, because an overlap is formed in the welded region of the band (i.e., where the two ends of the metallic strip are welded together to form the band), thereby forming a layer of metal that is twice as wide as the metallic strip, it has proven difficult to easily form a hook in the overlap region.

Furthermore, the conventional method of forming "hooks" in the upper and lower edges of the ring band includes bending a first edge to form a hook therein, turning the band over so that the other edge of the band may be bent, and bending the second edge of the band to form a hook therein. While this method has worked satisfactorily, the step of turning the band over to bend the second edge reduces the efficiency of ring band production, and results in increased costs and decreased output.

SUMMARY OF THE INVENTION

According to a first aspect of the present invention, there is provided a method of forming a ring for a container, including the following steps: providing a band having a first edge and a second edge, placing the band in an operational position, bending the first edge of the band, maintaining the band in the operational position, and bending the second edge of the band.

According to a second aspect of the present invention, there is provided a method of forming a container, including the following steps: providing a band having a first edge and a second edge, placing the band in an operational position, bending the first edge of the band, maintaining the band in the operational position, bending the second edge of the band, providing a container having a bottom wall and at least one side wall, the bottom wall and the at least one side wall defining an opening having an edge, placing the first edge of the band around the opening edge of the container, and crimping the first edge of the band around the opening edge of the container.

According to a third aspect of the present invention, an apparatus for forming a container ring includes at least one driving wheel, at least one biasing wheel operatively associated with the at least one driving wheel, the biasing wheel operable to bias a band having a first edge and a second edge against the at least one driving wheel, a first bending wheel operable to bend the first edge of the band as the band is rotated by the at least one driving wheel, and a second bending wheel operable to bend the second edge of the band as the band is rotated by the at least one driving wheel.

The present invention forms a container ring by sequentially bending the edges of a band, without an operator having to stop the apparatus after the first edge is bent to turn the band over so that the second edge can be bent. Furthermore, the present invention allows J-shaped hooks to be easily formed in welded sections of band closures.

DETAILED DESCRIPTION OF THE PRESENTLY PREFERRED EMBODIMENT

Figure 1:
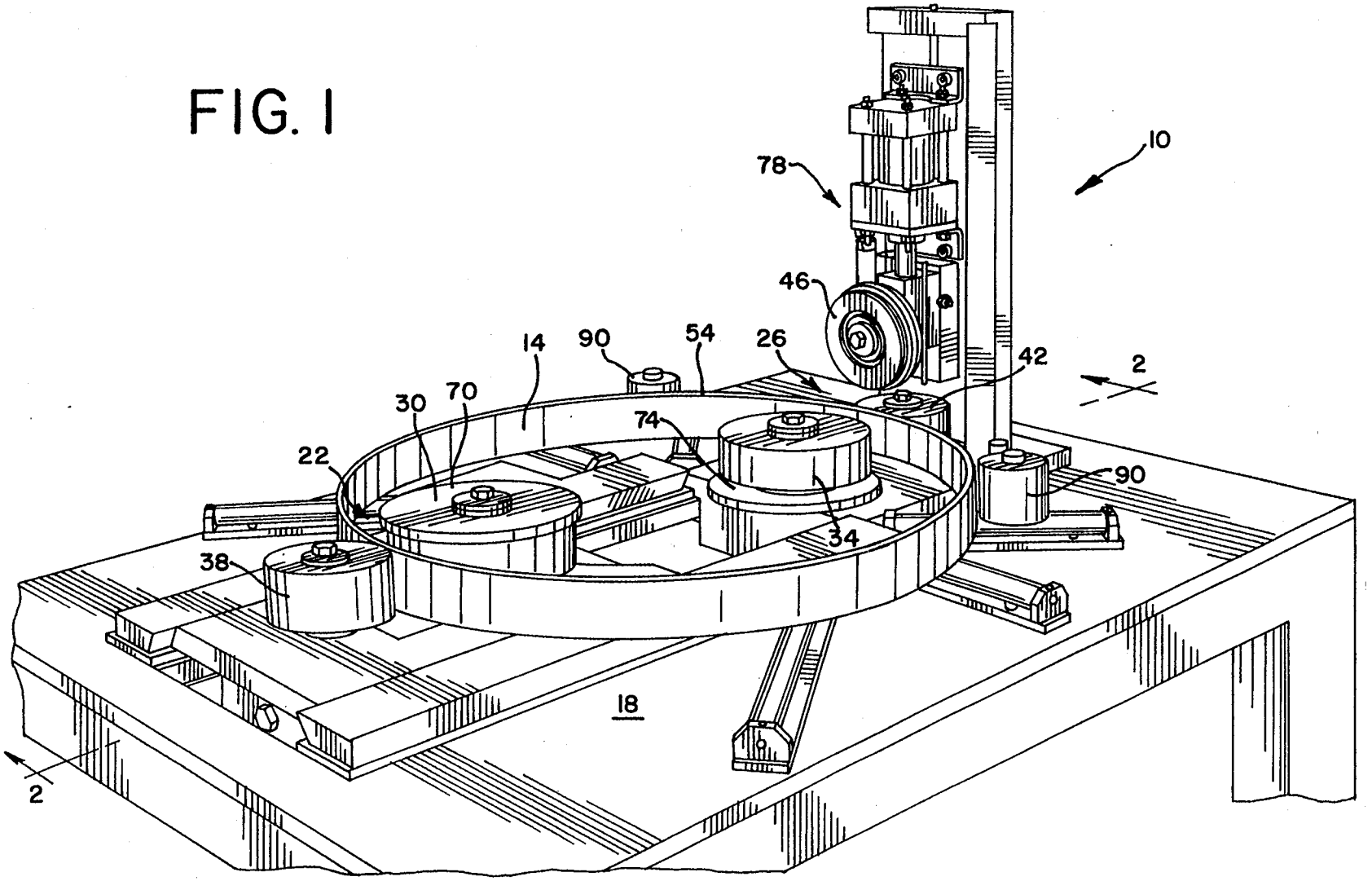
FIG. 1 is an upper perspective view of an apparatus for forming a container ring which incorporates the presently preferred embodiment of the present invention.
Figure 2:
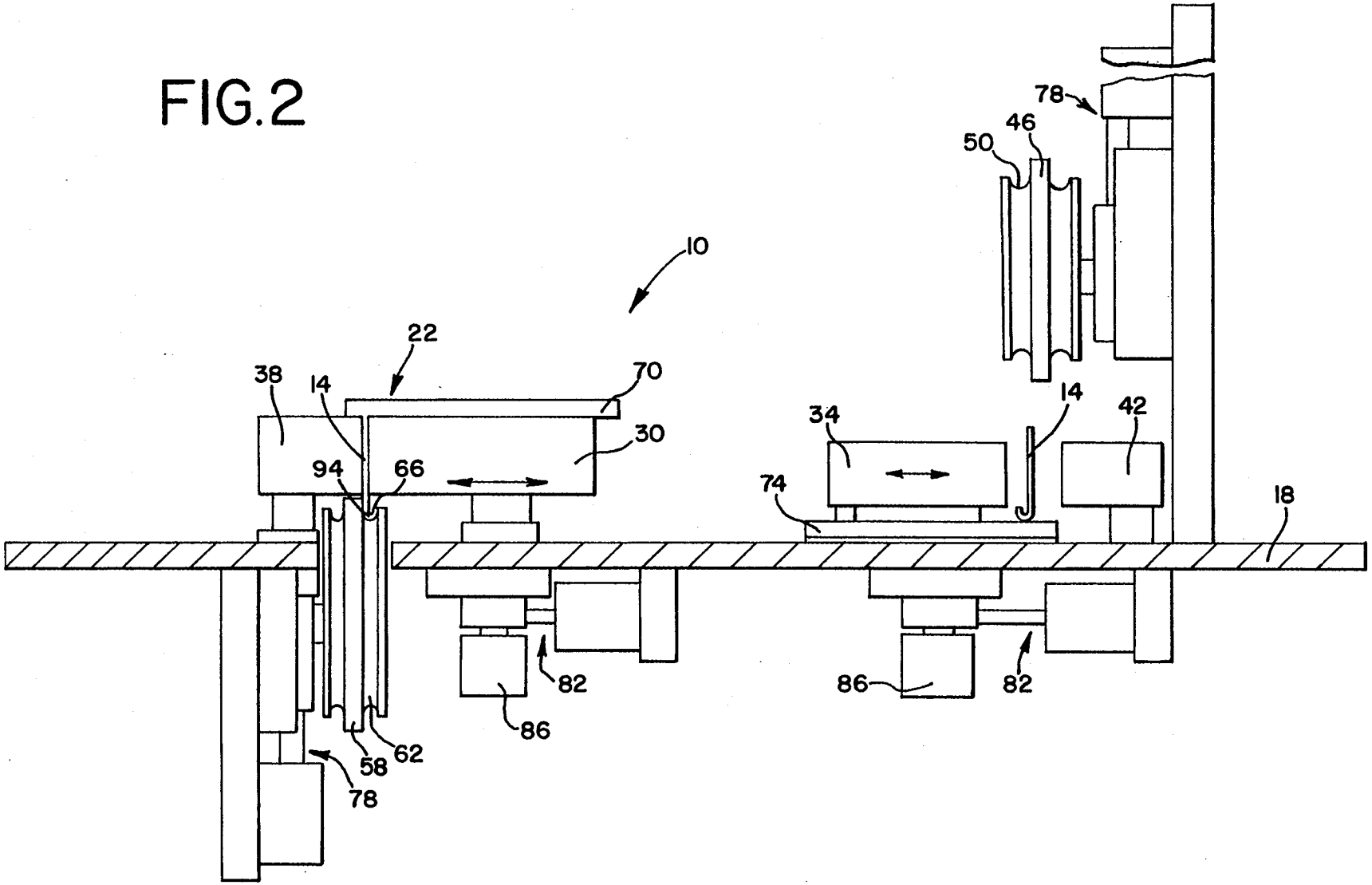
FIG. 2 is a schematic view of the apparatus taken along line 2—2 of FIG. 1.
Figure 3:
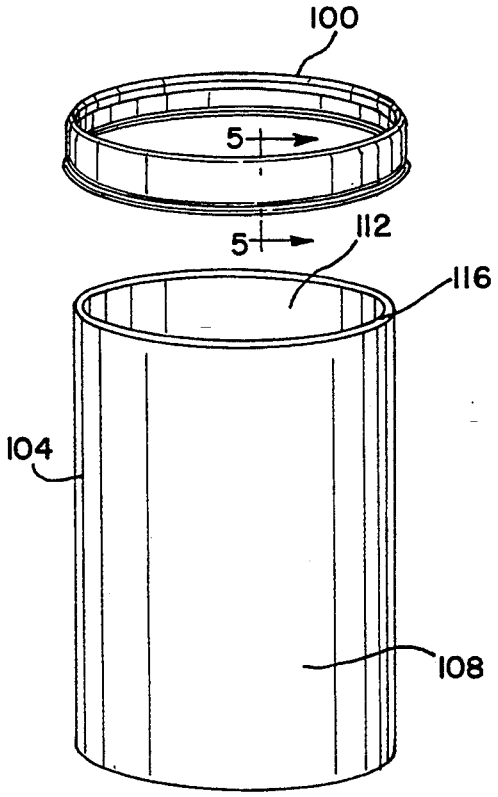
FIG. 3 is an exploded elevational view of a bulk container and a container ring formed according to the presently preferred embodiment of the present invention.
Figure 4:
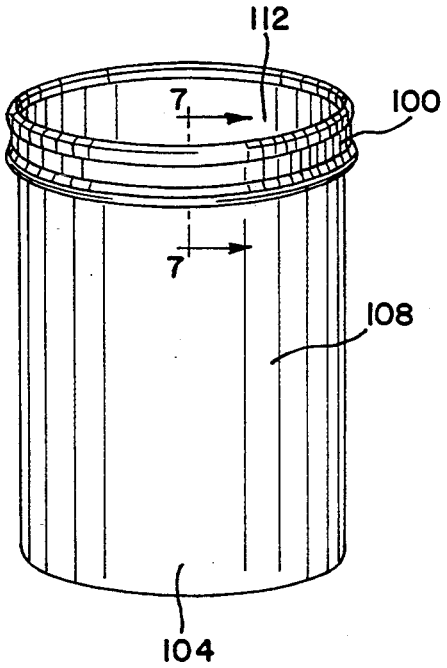
FIG. 4 is an elevational view of the container ring in place on the bulk container shown in FIG. 3.
Figure 5:
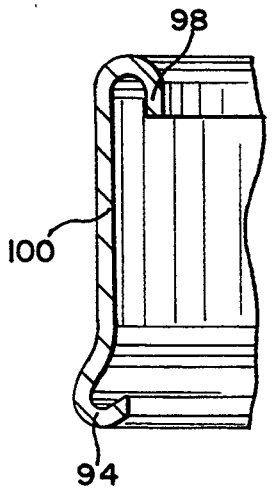
FIG. 5 is a cross-sectional view of the container ring taken along line 5—5 of FIG. 3.
Figure 6:
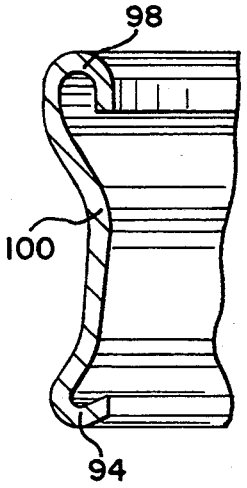
FIG. 6 is a cross-sectional view of the container ring shown in FIG. 4 after it is crimped to the bulk container.

Referring now to the drawings, FIGS. 1 and 2 illustrate the preferred embodiment of the apparatus 10 for forming a container ring. As stated above in the figure descriptions, FIG. 1 focuses on the upper portion of the apparatus 10, while FIG. 2 depicts a schematic view of the entire apparatus 10.

FIG. 1 shows a band 14 disposed within the apparatus 10 for forming a container ring. Preferably, the band 14 is initially formed of a metallic strip that is welded or otherwise joined at its ends to form the band 14. Alternately, however, the strip and, thus, the band 14 may be formed of any other suitable material, including plastic.

As shown in FIGS. 1 and 2, the apparatus 10 is disposed along a horizontal plane or operating table 18. As best shown in FIG. 1, the upper portion of the apparatus 10 includes first and second band driving units 22, 26. Each of the band driving units 22, 26 includes a driving wheel 30, 34 and a biasing wheel 38, 42 operatively associated with the driving wheel 30, 34. As will be subsequently explained in more detail, the first and second driving wheels 30, 34 operate to rotate the band 14 and to translate the band 14 into contact with the respective biasing wheels 38, 42, and the first and second biasing wheels 38, 42 operate to maintain or bias the band 14 in contact with the respective driving wheels 30, 34.

As best shown in FIG. 1, the apparatus 10 also includes an upper bending wheel 46 disposed above the operating table 18 and operatively associated with the second band driving unit 26. The upper bending wheel 46 defines a bending groove 50 therein and, as more fully explained below, is operable to be lowered to engage and bend a first edge 54 of the band 14 as the band 14 is rotated by the second driving wheel 34.

As shown in FIG. 2, the apparatus 10 further includes a lower bending wheel 58 defining a bending groove 62 therein. The lower bending wheel 58 is disposed below the operating table 18 and is operatively associated with the first band driving unit 22. As more fully explained below, the lower bending wheel 58 is operable to be raised to engage and bend a second edge 66 of the band 14 as the band 14 is rotated by the first driving wheel 30.

As best shown in FIG. 1, the first and second driving wheels 30, 34 each includes an extending flange 70, 74 operable to maintain the band 14 between the respective driving wheels 30, 34 and biasing wheels 38, 42 when the edges 54, 66 of the band 14 are bent by the bending wheels 46, 58. More specifically, when the first driving wheel 30 translates the band into contact with the first biasing wheel 38, the first extending flange 70 overlaps onto the first biasing wheel 38. This overlap operates to resist the upward force imparted on the band 14 by the lower bending wheel 58 when the lower bending wheel 58 is raised to bend the second edge 66 of the band 14, and to maintain the band 14 in a "trapped" condition between the first driving wheel 30 and the first biasing wheel 38 during the bending process. The second extending flange 74 on the second driving wheel 34 operates in the same fashion, except that its orientation is opposite to that of the first extending flange 70.

Additionally, as shown in FIG. 1, guide rollers 90 are positioned along the operating table 18 to stabilize the band 14 as it is being rotated and bent during the bending process.

While the constituent parts of the apparatus 10 may be powered by any suitable means, hydraulic and/or pneumatic piston-cylinder arrangements and hydraulic motors are the preferred power systems for the present invention. Hydraulic piston-cylinder arrangements 78 are preferably utilized to translate the upper and lower bending wheels 46, 58. Pneumatic piston-cylinder arrangements 82 are preferred for translating the first and second driving wheels 30, 34. Preferably, hydraulic motors 86 are used to rotate the first and second driving wheels 30, 34.

The above-described power systems 78, 82, 86 may be manually activated and controlled to perform their intended functions, as more fully discussed below. Preferably, however, the power systems 78, 82, 86 are controlled by one or more microprocessors or by limit switches, or a combination thereof, as is commonly known in the art.

The operation of the apparatus 10 will now be discussed. After the band 14 is placed within the apparatus 10, the apparatus is activated. First, the pneumatic piston-cylinder arrangement 82 translates the first driving wheel 30 and the band 14 toward the first biasing wheel 38 until the band 14 is "caught" therebetween and the first extending flange 70 overlaps the biasing wheel 38. Then, the hydraulic motor 86 is activated to rotate the first driving wheel 30, which in turn causes the band 14 to rotate. As the band 14 is rotated, the hydraulic piston-cylinder 78 is activated to raise the bending groove 62 of the lower bending wheel 58 into contact with the second edge 66 of the band 14. When the bending groove 62 is moved into contact with the second edge 66 of the band 14, the second edge 66 is bent until a safety hook 94 is formed therein. After the safety hook 94 is formed in the second edge 66, the lower bending wheel 58 is lowered, and the driving wheel 30 is deactivated and is translated away from the biasing wheel 38 to thereby "free" the band 14.

Second, directly after the band 14 is freed from between the first driving wheel 30 and the first biasing wheel 38, the pneumatic piston-cylinder arrangement 82 is activated to translate the second driving wheel 34 and the band 14 toward the second biasing wheel 42 until the band 14 is caught therebetween and the extending flange 74 overlaps the biasing wheel 42. The hydraulic motor 86 is then activated to rotate the second driving wheel 34, which in turn causes the band 14 to rotate. As the band 14 is rotated, the hydraulic piston-cylinder 78 is activated to lower the bending groove 50 of the upper bending wheel 46 into contact with the first edge 54 of the band 14. When the bending groove 50 is moved into contact with the first edge 54 of the band 14, the first edge 54 is bent until a J-shaped hook 98 is formed therein. After the J-shaped hook 98 is formed in the first edge 54, the upper bending wheel 46 is raised, and the driving wheel 34 is deactivated and is translated away from the biasing wheel 42 to thereby free the band 14.

After the above-described operation is completed, the apparatus 10 is deactivated and the finished container ring 100 is removed and attached to a bulk container 104, as will be fully described below. After the finished container ring 100 is removed from the apparatus 10, another band 14 may be placed within the apparatus 10 and the above-described bending operation repeated.

The bending operation may be used to bend the first edge 54 and the second edge 66 of the band 14 approximately an equal amount to form the safety hook 94 and the J-shaped hook 98. However, it is contemplated that the bending operation may be used to bend the edges 54, 66 of the band 14 into hooks of differing length or depth. Furthermore, it is contemplated that the first and second driving wheels 30, 34 may be used to rotate the band 14 in the same or opposite direction.

As shown in FIGS. 3–7, after the band 14 is formed into the finished container ring 100, the container ring is attached to a bulk container 104. The bulk container 104 may be formed of any suitable material, including metal, plastic or paper. The container 104 includes a bottom wall (not shown) and a side wall 108 defining an opening 112 having an edge 116.

Figure 7:
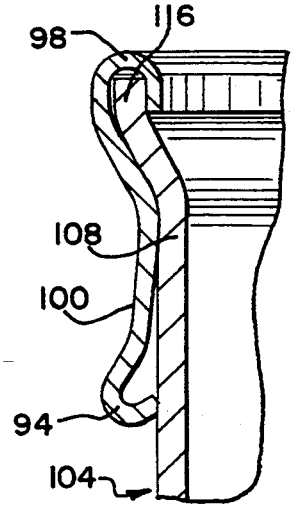
FIG. 7 is a cross-sectional view taken along line 7—7 of FIG. 4.

To attach the container ring 100 to the container 104, the container ring 100 is first slipped over the container 104 until the edge 116 of the container opening 122 fits within the J-shaped hook 98 (See FIG. 7). Then, the J-shaped hook 98 (i.e., the first edge 54 of the band 14) is crimped around the edge 116 of the opening 112, as is known in the art. After the J-shaped hook 98 and the opening edge 116 are crimped, the container ring 100 and the side wall 108 of the container 104 take on the configurations shown in FIGS. 6 and 7.

As best shown in FIG. 7, after the container ring 100 is attached to the container 104, the safety hook 94 (i.e., the second edge 66 of the band 14) rests against the side wall 108 of the container. The safety hook 94 prevents persons from injuring themselves on the container ring 100 when they lift and move the container 104.

The following materials may be suitable for use in the preferred embodiment of the present invention: the band 14 may be formed of metal or plastic; and the bulk container 104 may be formed of metal, plastic or paper.

As shown best in FIG. 1, the first and second band driving units 22, 26 are disposed opposite each other on the operating table 18. To accommodate various sizes of container rings, the driving units 22, 26 may be moved to and positioned at appropriate locations and intervals on the table 18, including locations where the driving units 22, 26 are positioned adjacent to one another.

The apparatus 10 described above allows both edges of a band 14 to be bent sequentially to form a container rings 100 without an operator having to invert the band 14 after one edge thereof has been bent to allow the second edge to be bent. This results in increased container ring production and efficiency. Furthermore, the apparatus 10 functions to easily form hooks 94, 98 in the edges 54, 66 of the band 14, even in the area of the band 14 where an overlap of material is formed due to the two ends of the strip being connected to form the band 14.

As described above, the second edge 66 of the band 14 is bent first to form the safety hook 94, and then the first edge 54 of the band 14 is bent to form the J-shaped hook 98. However, the order in which the edges 54, 66 of the band 14 are bent may be reversed.

It should be appreciated that the apparatus and method for forming a container ring of the present invention may be configured as appropriate for the application. The embodiment described above is to be considered in all respects only as illustrative and not restrictive. The scope of the invention is indicated by the following claims rather than by the foregoing description. All changes which come within the meaning and range of equivalency of the claims are to embraced within their scope.

What is claimed and desired to be secured by Letters Patent of the U.S. is:

1. A method of forming a ring for a container, comprising the following steps in the sequence set forth:

a) providing a band comprising a first edge and a second edge;

b) placing the band in a rotating operational position;

c) bending the first edge of the band while the band is in the rotating operational position;

d) maintaining the band in the rotating operational position;

e) bending the second edge of the band while the band is maintained in the rotating operational position.

2. The method of claim 1 wherein the band is formed from a strip having a first end and a second end, the first and second ends of the strip being joined to form the band.

3. The method of claim 1 wherein the first edge and the second edge are bent approximately an equal amount.

4. The method of claim 1 wherein the first edge and the second edge are bent to form hooks therein.

5. The method of claim 1 wherein the band is rotated about its axis during the bending processes of steps c) and e).

6. The method of claim 5 wherein the band is rotated in one direction during bending step c) and is rotated in an opposite direction during bending step e).

7. The method of claim 1, further comprising the following steps:

providing a container comprising a bottom wall and at least one side wall, the bottom wall and the at least one side wall defining an opening having an edge;

placing the bent first edge of the band around the opening edge of the container; and crimping the bent first edge of the band around the opening edge of the container.

8. A method of forming a container, comprising the following steps:

a) providing a band comprising a first edge and a second edge;

b) placing the band in a rotating operational position;

c) bending the first edge of the band while the band is in the rotating operational position;

d) maintaining the band in the rotating operational position;

e) bending the second edge of the band while the band is maintained in the rotating operational position;

f) providing a container comprising a bottom wall and at least one side wall, the bottom wall and the at least one side wall defining an opening having an edge;

g) placing the bent first edge of the band around the opening edge of the container; and h) crimping the bent first edge of the band around the opening edge of the container.

9. The method of claim 8 wherein the second edge rests against the outer side of the at least one side wall.

10. The method of claim 8 wherein the first edge is bent in step c) to form a J-shaped hook.

11. The method of claim 8 wherein the container is formed from a material selected from the group consisting of metallic, plastic and paper-based material.

12. The method of claim 8 wherein the band is rotated about its axis during the bending processes of steps c) and e).

13. The method of claim 12 wherein the band is rotated in one direction during bending step c) and is rotated in an opposite direction during bending step e).

14. A method of forming a ring for a container, comprising the following steps:

a) providing a band comprising a first edge and a second edge;

b) placing the band in a rotating operational position;

c) rotating the band in a first direction;

d) bending the first edge of the band while the band is rotated in the first direction;

e) maintaining the band in the rotating operational position;

f) rotating the band in a direction opposite the first direction; and g) bending the second edge of the band while the band is rotated in the opposite direction.

* * * * *